US009510631B2

(12) United States Patent
Kim et al.

(10) Patent No.: US 9,510,631 B2
(45) **Date of Patent: *Dec. 6, 2016**

(54) ARTIFICIAL HAIR PACKAGE ASSEMBLY AND METHOD

(71) Applicant: SHAKE-N-GO FASHION, INC., Port Washington, NY (US)

(72) Inventors: Hye Sun Kim, Port Washington, NY (US); James K. Kim, Manhasset, NY (US); Peter Ough, Bayside, NY (US)

(73) Assignee: SHAKE-N-GO FASHION, INC., Port Washington, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/930,063

(22) Filed: Nov. 2, 2015

(65) Prior Publication Data

US 2016/0213083 A1 Jul. 28, 2016

Related U.S. Application Data

(63) Continuation-in-part of application No. 14/607,511, filed on Jan. 28, 2015, now Pat. No. 9,198,476.

(51) Int. Cl.

| | |
|---|---|
| ***B65D 57/00*** | (2006.01) |
| ***A41G 5/00*** | (2006.01) |
| ***B65D 85/00*** | (2006.01) |
| ***B65D 75/32*** | (2006.01) |
| ***B65D 25/10*** | (2006.01) |

(52) U.S. Cl.

CPC ..... *A41G 5/004* (2013.01); *A41G 5/0046* (2013.01); *A41G 5/0086* (2013.01); *B65D 25/10* (2013.01); *B65D 75/32* (2013.01); *B65D 75/322* (2013.01); *B65D 85/70* (2013.01)

(58) Field of Classification Search

CPC ..... B65D 25/10; B65D 75/322; B65D 75/327; B65D 75/36; B65B 5/04; A41G 5/0046; A41G 5/0086

USPC ..... 206/278, 287, 292, 297, 388, 461–471,206/806; 132/53, 54, 56, 273–276

See application file for complete search history.

(56) References Cited

U.S. PATENT DOCUMENTS

| | | | | |
|---|---|---|---|---|
| 4,453,629 A | | 6/1984 | Goldberg | |
| 4,485,921 A | * | 12/1984 | Geller | B65D 73/00 206/281 |
| 4,653,642 A | * | 3/1987 | Hakun | B65D 75/28 206/457 |
| 5,129,516 A | * | 7/1992 | Theros | B65D 75/225 206/389 |
| 5,447,232 A | * | 9/1995 | Chow | B65D 75/245 206/372 |

(Continued)

*Primary Examiner* — Luan K Bui

(74) *Attorney, Agent, or Firm* — Cowan, Liebowitz & Latman, P.C.; Mark Montague; Brian R. Volk

(57) ABSTRACT

An artificial hair package assembly is provided. The assembly includes a base member including a first body and a second body, the first body including a first exterior surface and the second body including a second exterior surface; a first securing member including a first interior surface; a second securing member including a second interior surface; and a hair product including a first portion and a second portion, the first portion being disposed between the first interior surface of the first securing member and the first exterior surface of the first body and the second portion being disposed between the second interior surface of the second securing member and the second exterior surface of the second body.

19 Claims, 10 Drawing Sheets

(56) References Cited

U.S. PATENT DOCUMENTS

| | | | | |
|---|---|---|---|---|
| 5,522,499 | A * | 6/1996 | DeBiasio | B65D 85/18 206/278 |
| 5,890,594 | A * | 4/1999 | Hansen | B65D 75/245 206/216 |
| 6,237,762 | B1 * | 5/2001 | Faircloth | B65D 73/0078 206/297 |
| 6,330,945 | B1 | 12/2001 | Reimer | |
| D506,925 | S | 7/2005 | Plumer | |
| D531,495 | S | 11/2006 | Hardy et al. | |
| 7,201,171 | B2 * | 4/2007 | Sthair | A41G 5/008 132/53 |
| 8,439,237 | B2 | 5/2013 | Choi | |
| 8,590,543 | B2 | 11/2013 | Goff et al. | |
| 8,695,792 | B2 | 4/2014 | Choi | |
| 2003/0159962 | A1 * | 8/2003 | Heo | B65D 73/0071 206/461 |
| 2007/0283975 | A1 * | 12/2007 | Ma | A41G 5/0093 132/53 |
| 2010/0088939 | A1 | 4/2010 | Maniwa | |
| 2014/0261529 | A1 | 9/2014 | Carvalho | |

* cited by examiner

ARTIFICIAL HAIR PACKAGE ASSEMBLY AND METHOD

REFERENCE TO RELATED APPLICATION

This application is a continuation-in-part application of U.S. Non-Provisional application Ser. No. 14/607,511, filed with the U.S. Patent and Trademark Office on Jan. 28, 2015, U.S. Pat. No. 9,198,476, the entire content of which is incorporated herein by reference.

BACKGROUND

1. Field of the Invention

The present invention relates generally to hair product packaging, and more particularly, to an artificial hair package assembly and method.

2. Description of the Related Art

Hair extensions and hair weaves are used by individuals to enhance the appearance of their natural hair. Hair extensions and hair weaves, or wefts of hair in general, include multiple strands of hair attached together to form a unit that can be secured to an individual's scalp. Incorporating natural or artificial hair, hair extensions and hair weaves can be used by individuals to either conceal or supplement their natural hair. In some cases, individuals use hair extensions and hair weaves when they are experiencing baldness or thinning of their natural hair. For those experiencing baldness or thinning of natural hair, use of hair extensions and hair weaves provides an alternative to use of potentially dangerous hair growth drugs or chemicals, or uncomfortable hair plugs.

Hair extensions and hair weaves may also be used to provide an individual with an alternative hair color while also providing added volume and/or length to the individual's natural hair in order to improve their appearance. Furthermore, hair extensions and hair weaves can be used by individuals to present an alternative texture to their own hair, such as changing their hair from straight to curly. Just as many people enjoy accessorizing their wardrobe, people who wear hair extensions and hair weaves enjoy changing their appearance by adding hair extensions and hair weaves to their natural hair.

SUMMARY

Accordingly, an embodiment provides an artificial hair package assembly. The assembly includes a base member including a first body and a second body, the first body including a first exterior surface and the second body including a second exterior surface; a first securing member including a first interior surface; a second securing member including a second interior surface; and a hair product including a first portion and a second portion, the first portion being disposed between the first interior surface of the first securing member and the first exterior surface of the first body and the second portion being disposed between the second interior surface of the second securing member and the second exterior surface of the second body.

According to further embodiments: the first exterior surface of the first body and the second exterior surface of the second body face substantially opposite directions; the first body includes a first upper portion and a first lower portion and the second body includes a second upper portion and a second lower portion, and wherein the first upper portion and the second upper portion comprise a first type of surface, the first lower portion and the second lower portion comprise a second type of surface, and the first type of surface is different from the second type of surface; the first body includes a first upper portion and a first lower portion and the second body includes a second upper portion and a second lower portion, wherein the first upper portion includes a first planar surface and the first lower portion includes a first arcuate surface, and wherein the second upper portion includes a second planar surface and the second lower portion includes a second arcuate surface; the first planar surface includes at least more than half of a length of the first body and the first arcuate surface includes less than half of the length of the first body; the first body is connected to the second body by a support body, wherein the support body is disposed between the first body and the second body, and wherein a first lower portion of the first body is connected to the support body and a first upper portion of the first body is coupled to the second body by an attachment member, and wherein a second lower portion of the second body is connected to the support body and a second upper portion of the second body is coupled to the first body by the attachment member; and the first body includes a first ridge member and the second body includes a second ridge member, and wherein the first ridge member and the second ridge member are configured such that the hair product is secured to the base member by wrapping the hair product around the first ridge member and the second ridge member.

An additional embodiments provides an artificial hair package assembly. The artificial hair package assembly includes a base member including a body portion, the body portion including an exterior surface that includes a body upper planar surface and a body lower arcuate surface; a securing member including an interior surface, the interior surface including a securing member upper planar surface and a securing member lower arcuate surface; and a hair product including a first portion and a second portion, wherein the first portion is at least partially disposed between the body upper planar surface of the body portion and the securing member planar surface of the securing member and the second portion is at least partially disposed between the body lower arcuate surface of the body portion and the securing member lower arcuate surface.

According to further embodiments: the body planar surface includes at least more than half of a length of the body portion and the body arcuate surface includes less than half of the length of the body portion; the body includes a ridge member, and wherein the ridge member is configured such that the hair product is secured to the base member by wrapping the hair product around the ridge member; the body portion includes peripheral edges and the ridge member extends across the exterior surface from the peripheral edges of the body portion; and the first portion of the hair product contacts each of the body upper planar surface and the securing member planar surface and the second portion of the hair product contacts each of the body lower arcuate surface and the securing member arcuate surface.

An additional embodiment provides an artificial hair package assembly. The artificial hair package assembly includes: a base member including a body portion, the body portion including an exterior surface; a securing member including an interior surface; a hair product; a ridge member configured such that the hair product is secured to the base member by wrapping the hair product around the ridge member, wherein the hair product is at least partially disposed between the exterior surface of the body portion and the interior surface of the securing member.

According to further embodiments: the body portion includes peripheral edges and the ridge member extends across the exterior surface from the peripheral edges of the body portion; the hair product contacts each of the exterior surface of the body portion and the interior surface of the securing member; the ridge member includes a plurality of ridge members protruding from the exterior surface of the body portion; the body portion further includes a groove member disposed adjacent to at least one of the ridge members; the groove member is disposed between at least two of the ridge members; the ridge members extend a distance across the body portion greater than a distance between at least two of the groove members; and the body portion includes a top edge and at least a portion of the ridge member extends across the top edge of the body portion.

BRIEF DESCRIPTION OF THE DRAWINGS

The above and other aspects, features and advantages of certain embodiments will be more apparent from the following detailed description taken in conjunction with the accompanying drawings, in which.

DETAILED DESCRIPTION

The following detailed description of certain embodiments will be made in reference to the accompanying drawings. In the detailed description, explanation about related functions or constructions known in the art are omitted for the sake of clearness in understanding the concept of the invention, to avoid obscuring the invention with unnecessary detail.

Figure 1:
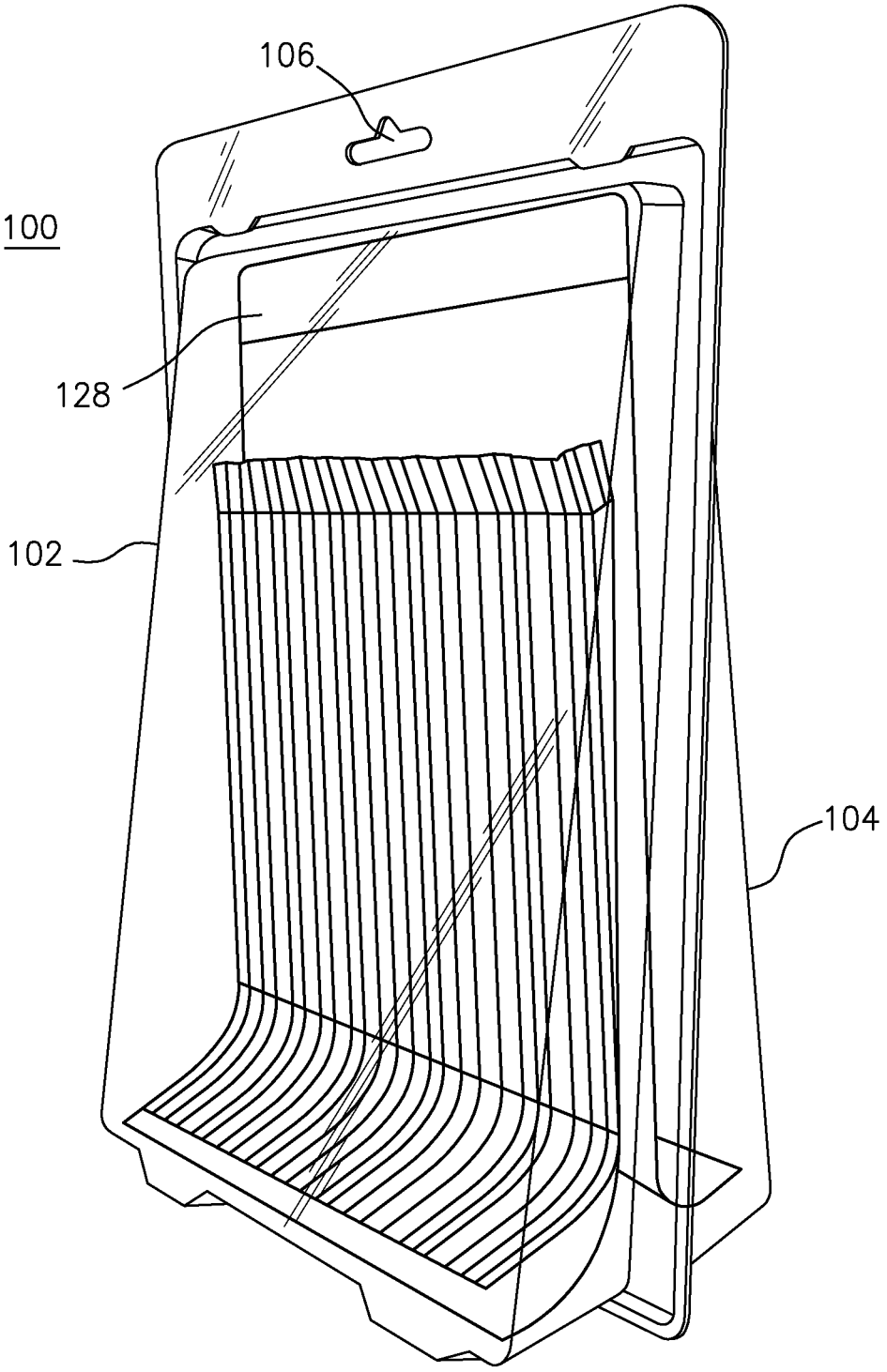
FIG. 1 illustrates a perspective view of an artificial hair package assembly in an assembled configuration.

FIG. 1 illustrates a perspective view of an artificial hair package assembly 100 in an assembled configuration. The assembly 100 may include a blister package encasement. The encasement includes a first shell member 102 and a second shell member 104. The first shell member 102 and the second shell member 104 protect a hair product disposed within. The first shell member 102 and the second shell member 104 each include shell apertures 106. The shell apertures 106 enable the assembly 100 to be hung from, for example, a hook.

Figure 2:
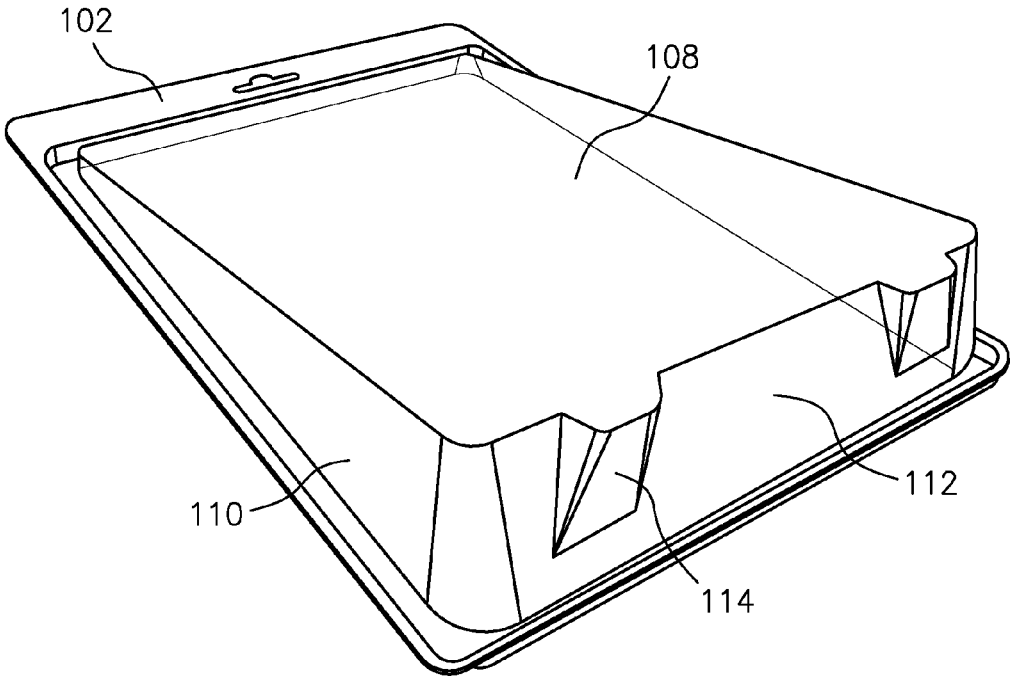
FIG. 2 illustrates a bottom rear perspective view of a first shell member.

FIG. 2 illustrates a bottom rear perspective view of the first shell member 102. The first shell member 102 includes a first shell planar surface 108, multiple first shell sidewall surfaces 110, and a first shell base surface 112. The first shell base surface 112 includes multiple first shell protruding members 114 extending away from the first shell base surface 112. The first shell protruding members 114 allow the assembly 100 to maintain an upright position when the assembly 100 is in the assembled configuration.

Figure 3:
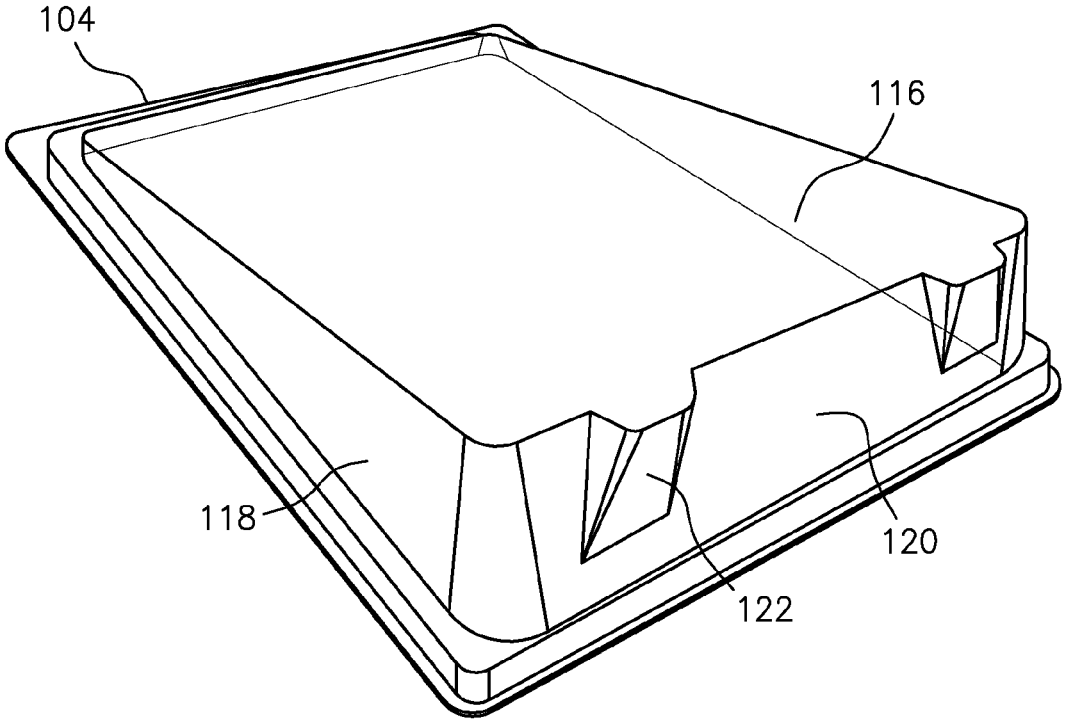
FIG. 3 illustrates a bottom rear perspective view of a second shell member.

FIG. 3 illustrates a bottom rear perspective view of the second shell member 104. The second shell member 104 includes a second shell planar surface 116, multiple second shell sidewall surfaces 118, and a second shell base surface 120. The second shell base surface 120 includes multiple second shell protruding members 122 extending away from the second shell base surface 120. The second shell protruding members 122 balance the first shell protruding members 114 allowing the assembly 100 to maintain the upright position when the assembly 100 is in the assembled configuration.

Figure 4:
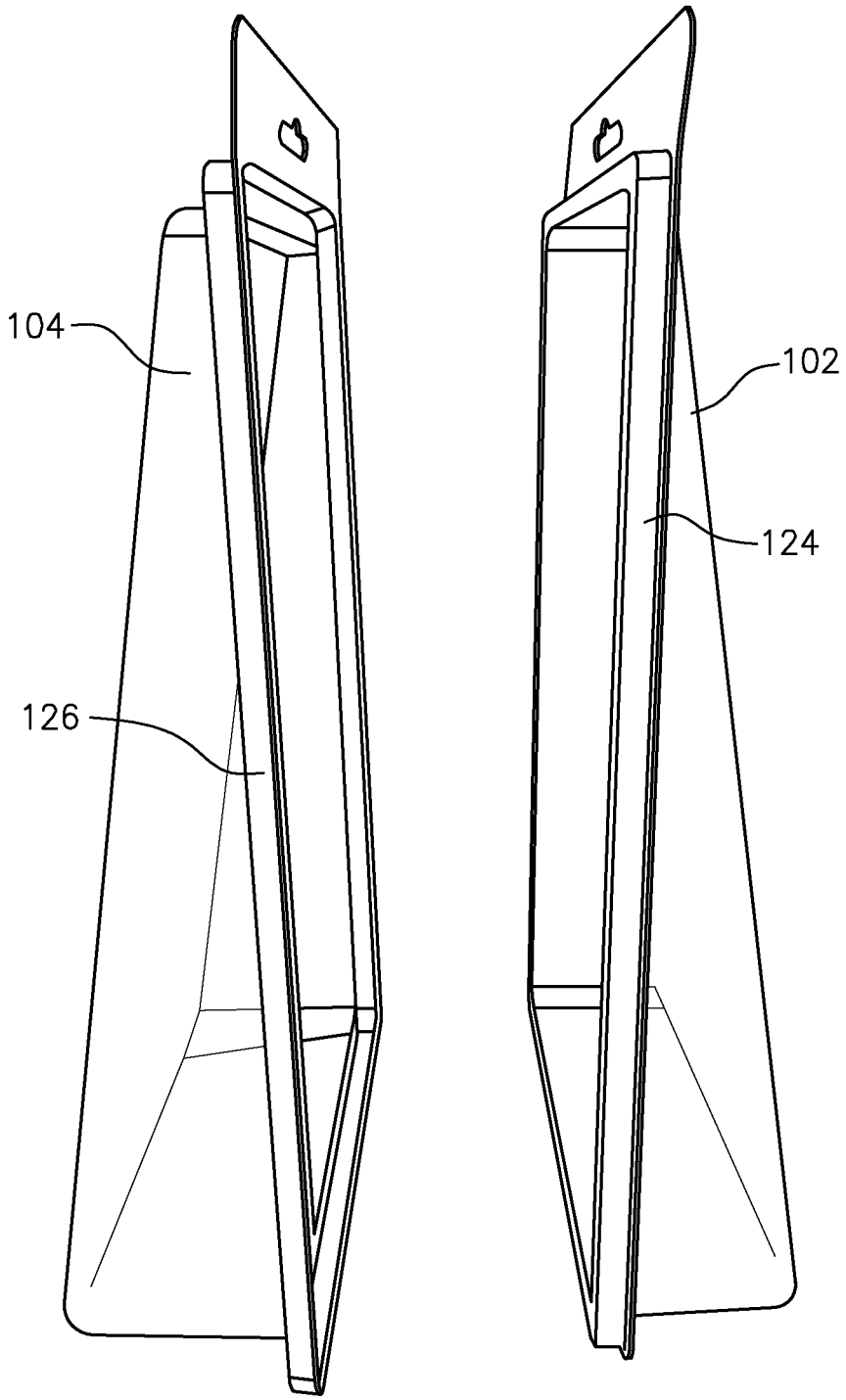
FIG. 4 illustrates a side view of the first shell member and the second shell member.

FIG. 4 illustrates a side view of the first shell member 102 and the second shell member 104. The first shell member 102 includes a first shell insertion rim 124 protruding from the first shell sidewall surface 110. The first shell insertion rim 124 may extend around an entire perimeter of the first shell member 102. The second shell member 104 includes a second shell receiving groove 126 extending from the second shell sidewall surface 118. The second shell receiving groove 126 may extend around an entire perimeter of the second shell member 104. The first shell insertion rim 124 is inserted into the second shell receiving groove 126, releasably interlocking the first shell member 102 with the second shell member 104. A bottom portion of the first shell insertion rim 124 may be permanently molded to a bottom portion of the second shell receiving groove 126. Alternatively, the bottom portion of the first shell insertion rim 124 may be removably connected to a bottom portion of the second shell receiving groove 126 by, for example, tape, glue or other methods of attachment.

Figure 5A:
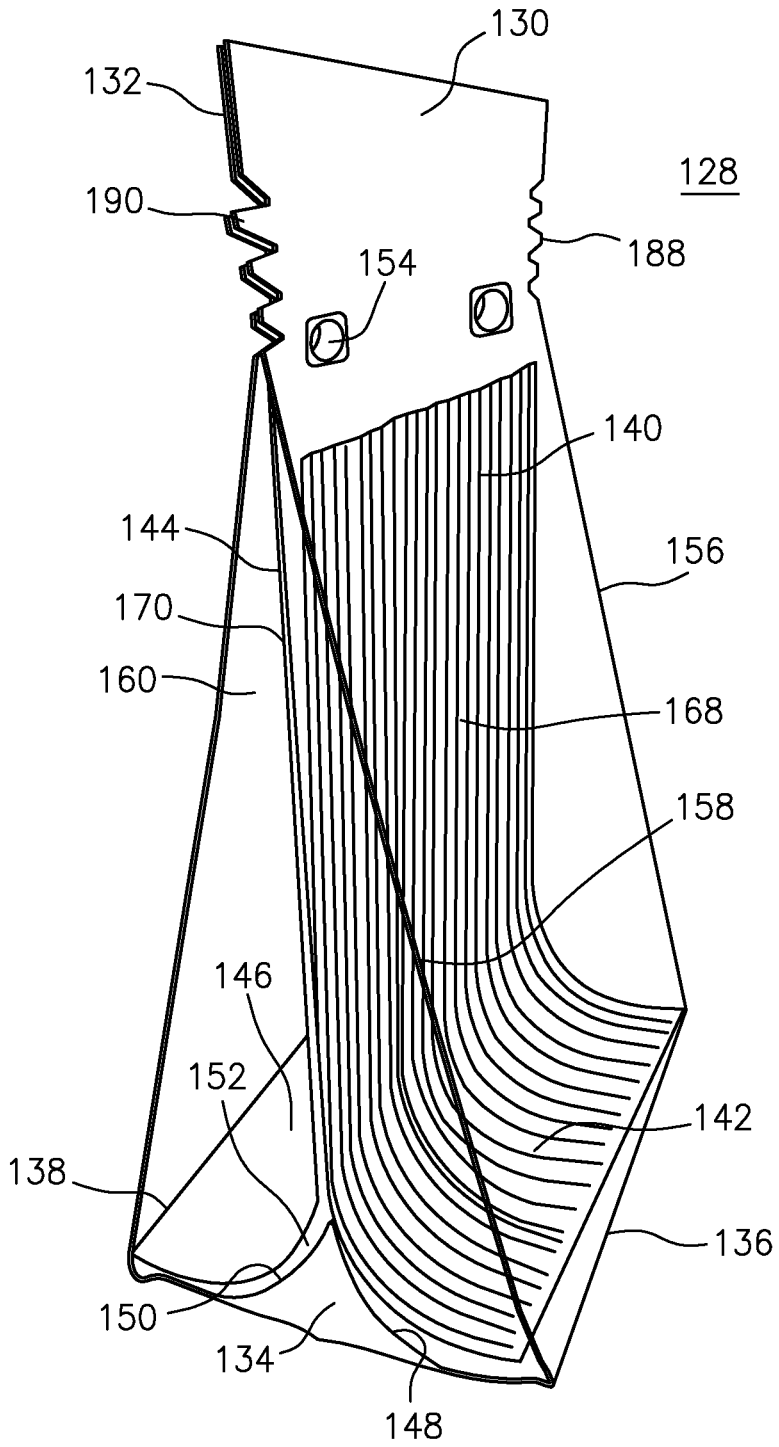
FIGS. 5A-5C illustrate perspective views of various embodiments of a base member.

FIG. 5A illustrates a perspective view of a base member 128. The assembly 100 includes the base member 128 and the base member 128 may be disposed within the blister package encasement described above and as illustrated in FIG. 1. The base member 128 includes a first body 130 connected to a second body 132 by a support body 134. The support body 134 is disposed between the first body 130 and the second body 132. The first body 130 is rotatably connected to the support body 134 at edge 136. The second body 132 is rotatably connected to the support body 134 at edge 138.

The first body 130 includes a first upper portion 140 and a first lower portion 142. The second body 132 includes a second upper portion 144 and a second lower portion 146. The first upper portion 140 and the second upper portion 144 may be configured as a first type of surface. The first lower portion 142 and the second lower portion 146 may be configured as a second type of surface. A curvature of the first type of surface may be different from the second type of surface. For example, the first upper portion 140 may be configured as a first planar surface and the first lower portion 142 may be configured as a first arcuate surface. The first planar surface may extend more than half of a length of the first body 130 and the first arcuate surface may extend less than half of the length of the first body 130. The first planar surface may extend at least two thirds of a length of the first body 130 and the first arcuate surface may extend less than or equal to one third of the length of the first body 130.

The second upper portion 144 may be configured as a second planar surface and the second lower portion 146 may be configured as a second arcuate surface. The second planar surface may extend at least more than half of a length of the second body 132 and the second arcuate surface may extend less than half of the length of the second body 132. The second planar surface may extend at least two thirds of a length of the second body 132 and the second arcuate surface may extend less than or equal to one third of the length of the second body 132. The first planar surface and the second planar surface may be configured substantially parallel to each other.

The support body 134 includes a first supporting arcuate surface 148 and a second supporting arcuate surface 150. Upper portions of the first supporting arcuate surface 148 and the second supporting arcuate surface 150 face substantially opposite directions. The first supporting arcuate surface 148 and the second supporting arcuate surface 150 meet at a central portion 152 of the support body 134, which is positioned at an apex between the first supporting arcuate surface 148 and the second supporting arcuate surface 150. The first arcuate surface of the first lower portion 142 may be coupled to the first supporting arcuate surface 148 and the second arcuate surface of the second lower portion 146 may be coupled to the second supporting arcuate surface 150.

The first lower portion 142 of the first body 130 is connected to the support body 134 and the first upper portion 140 of the first body 130 is releasably coupled to the second body 132 by an attachment member 154. The second lower portion 146 of the second body 132 is connected to the support body 134. The second upper portion 144 of the second body 132 is releasably coupled to the first body 130 by the attachment member 154. The attachment member 154 includes a male insertion member positioned on the second body 132 that snaps into a female receiving member positioned on the first body 130. The attachment member 154 may, alternatively, connect the first body 130 to the second body 132 by, for example, taping, gunning, and/or gluing, any portion thereof to hold the first body 130 and the second body 132 together. The term "gunning" refers to use of a tag attacher gun, such as the type of tag attacher gun used to attach a hang tag to clothing.

The first body 130 includes a first body sidewall 156 and a second body sidewall 158. The first body sidewall 156 and the second body sidewall 158 each extend perpendicularly away from edges of a first exterior surface 168 of the first body 130. A surface of the first body sidewall 156 and a surface of the second body sidewall 158 are substantially parallel. The first body sidewall 156 and the second body sidewall 158 each include a lower portion and an upper portion. A width of the lower portion may be greater than a width of the upper portion for each of the first body sidewall 156 and the second body sidewall 158.

Figure 7:
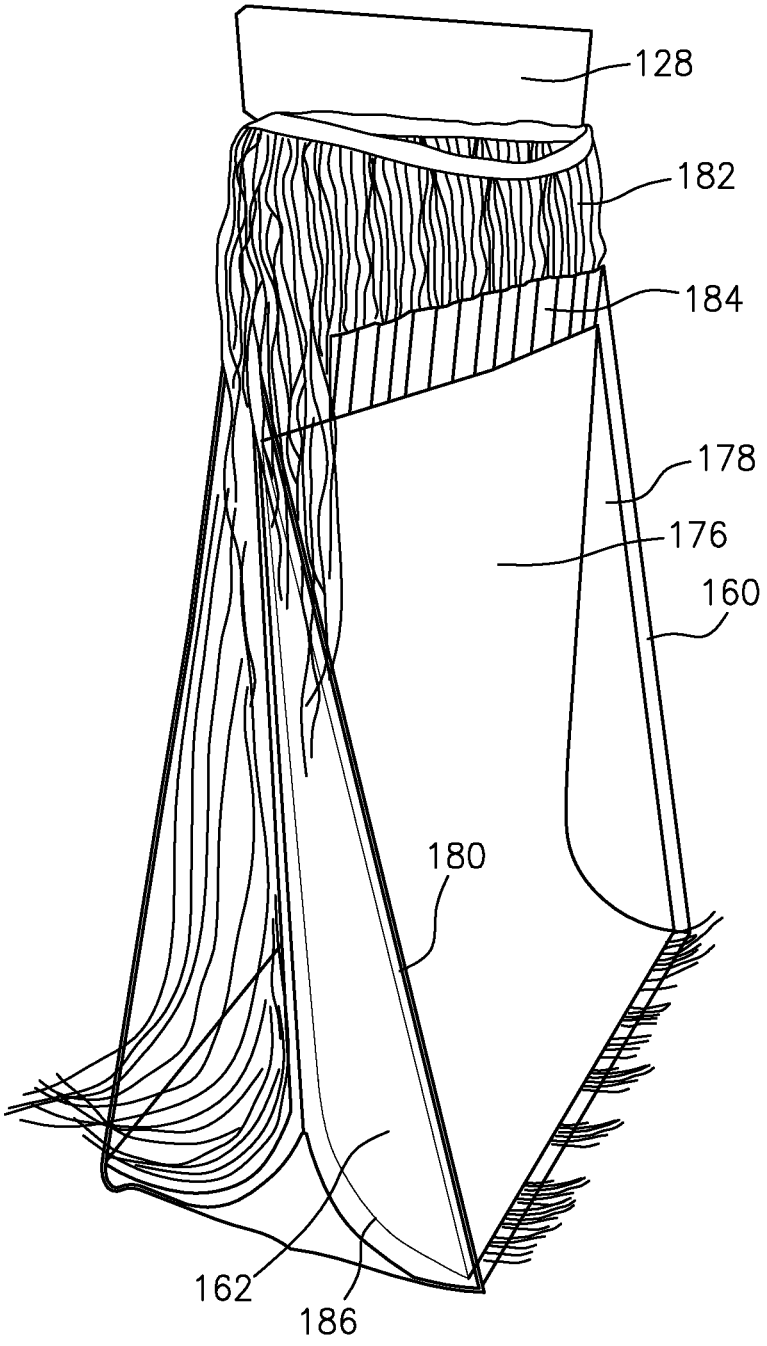
FIG. 7 illustrates a perspective view of a hair product coupled to the base member.

The second body 132 includes a third body sidewall 160 and a fourth body sidewall 162, see FIG. 7, extending perpendicularly away from edges of a second exterior surface 170 of the second body 132. A surface of the third body sidewall 160 and a surface of the fourth body sidewall 162 are substantially parallel. The third body sidewall 160 and the fourth body sidewall 162 each include a lower portion and an upper portion. A width of the lower portion may be greater than a width of the upper portion for each of the third body sidewall 160 and the fourth body sidewall 162. The first exterior surface 168 of the first body 130 and the second exterior surface 170 of the second body 132 face substantially opposite directions.

The first body 130 includes first groove members 188 and the second body 132 includes second groove members 190. The first groove members 188 are positioned on opposite peripheral edges of the first body 130, adjacent to, and above, the first body sidewall 156 and the second body sidewall 158. The second groove members 190 are positioned on opposite peripheral edges of the second body 132, adjacent to, and above, the third body sidewall 160 and the fourth body sidewall 162. As described in further detail below, a hair product 182 is secured to the base member 128 by wrapping the hair product 182 around the first groove members 188 and the second groove members 190. The first groove members 188 and the second groove members 190 allow the hair product 182 to be tightened and held in place so that the hair product 182 does not slip down or come unraveled. Additional gunning or other attachment methods may be used to hold the hair product 182 in place after wrapping the hair product 182 around the first groove members 188 and the second groove members 190.

Figure 5B:
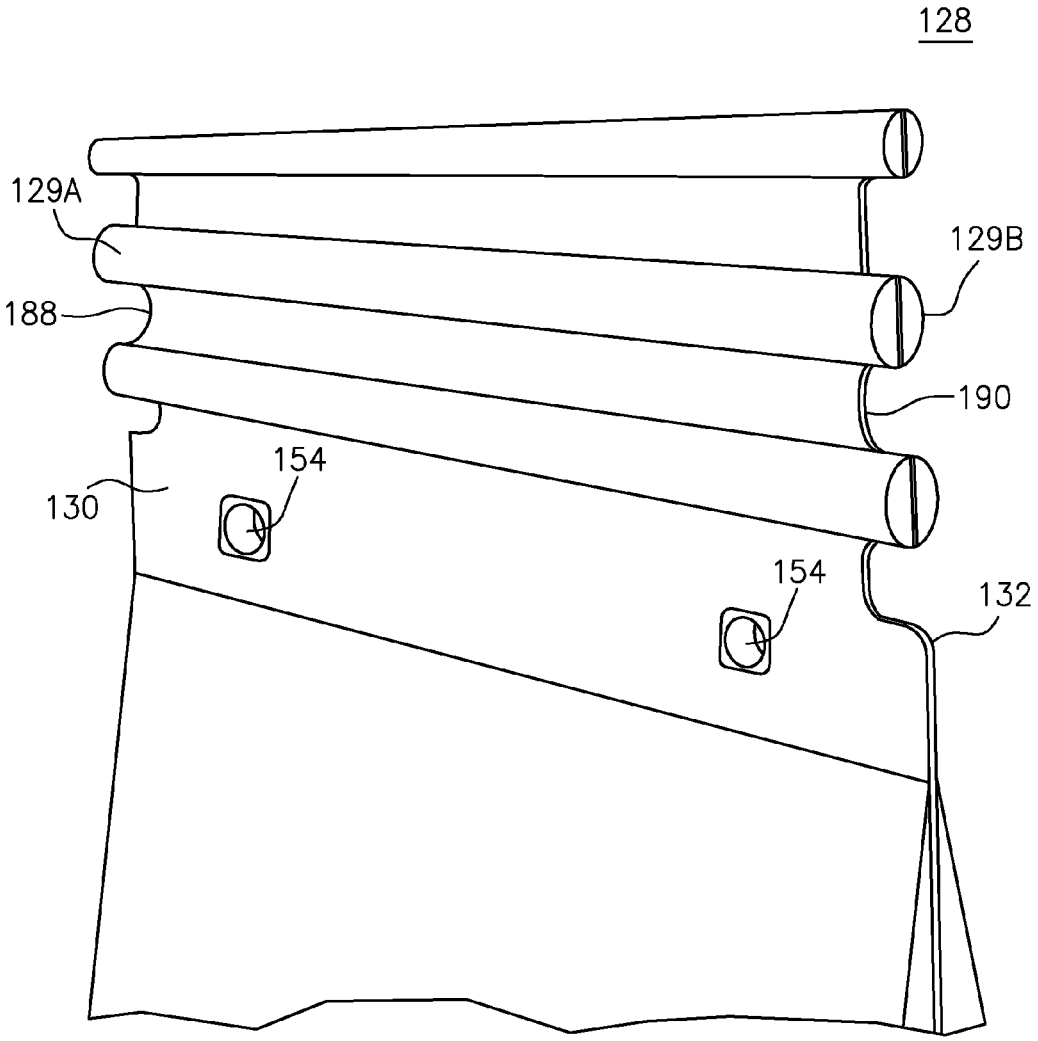

FIG. 5B illustrates a perspective view of the base member 128, according to an alternative embodiment. The base member 128 includes a first ridge member 129A and a second ridge member 129B. The first ridge member 129A and the second ridge member 129B protrude from the first exterior surface 168 and the second exterior surface 170, respectively. The first ridge member 129A and the second ridge member 129B assist the first groove members 188 and the second groove members 190 in preventing the hair product 182 from slipping up or down on the surface of the base member 128, and thus secure the hair product 182 to the base member 128.

The first ridge member 129A is disposed on the first body 130 adjacent to at least one of the first groove members 188. The first ridge member 129A may include multiple first ridge members disposed between and/or adjacent to each of the first groove members 188. That is, the first ridge member 129A may be disposed below a top edge of the first body 130, in which case the first ridge member 129A is adjacent to, and below, one of the first groove members 188. Alternatively, as illustrated in FIG. 5B, the first ridge member 129A may include multiple first ridge members. In this case at least one of the first ridge members 129A is disposed on the top edge of the first body 130 and at least one of the first ridge members 129A is disposed below at least one of the first groove members 188. When there are at least three of the first ridge members 129A, the first ridge members 129A are disposed both adjacent to and between the first groove members 188. The first ridge member 129A may be embodied as a half-cylinder shape, as illustrated in FIG. 5B, or, in any other suitable shape that protrudes from the first body 130, such as a half-oval, half-square etc.

The second ridge member 129B is disposed on the second body 132 adjacent to at least one of the second groove members 190. The second ridge member 129B may include multiple second ridge members disposed between and/or adjacent to each of the second groove members 190. That is, the second ridge member 129B may be disposed below a top edge of the second body 132, in which case the second ridge member 129B is adjacent to, and below, one of the second groove members 190. Alternatively, as illustrated in FIG. 5B, the second ridge member 129B may include multiple second ridge members. In this case, at least one of the second ridge members 129B is disposed on the top edge of the second body 132 and at least one of the second ridge members 129B is disposed below at least one of the second groove members 190. When there are at least three of the second ridge members 129B, the second ridge members 129B are disposed both adjacent to and between the second groove members 190. The second ridge member 129B may be embodied as a half-cylinder shape, as illustrated in FIG. 5B, or, in any other suitable shape that protrudes from the second body 132, such as a half-oval, half-square etc.

Accordingly, when the first body 130 and the second body 132 are coupled together, the first ridge member 129A and the second ridge member 129B form a completed shape, such as a complete cylinder. Each of the first ridge member 129A and the second ridge member 129B extend horizontally from the vertical peripheral edges of the first body 130 and the second body 132, respectively, beyond the first groove members 188 and the second groove members 190.

That is, the first ridge member 129A and the second ridge member 129B extend a distance across the first body 130 and the second body 132, respectively, greater than a distance between at least two of the first groove members 188, which are disposed on opposite peripheral edges of the first body 130, and greater than a distance between at least two of the second groove members 190, which are disposed on opposite peripheral edges of the second body 132.

The first ridge member 129A and the second ridge member 129B may extend up to the peripheral edges, beyond the peripheral edges, and/or terminate prior to the peripheral edges, of the first body 130 and the second body 132, respectively. Furthermore, the first ridge member 129A and the second ridge member 129B may include portions that do not protrude from the first body 130 and the second body 132 disposed between the peripheral edges thereof.

Figure 5C:
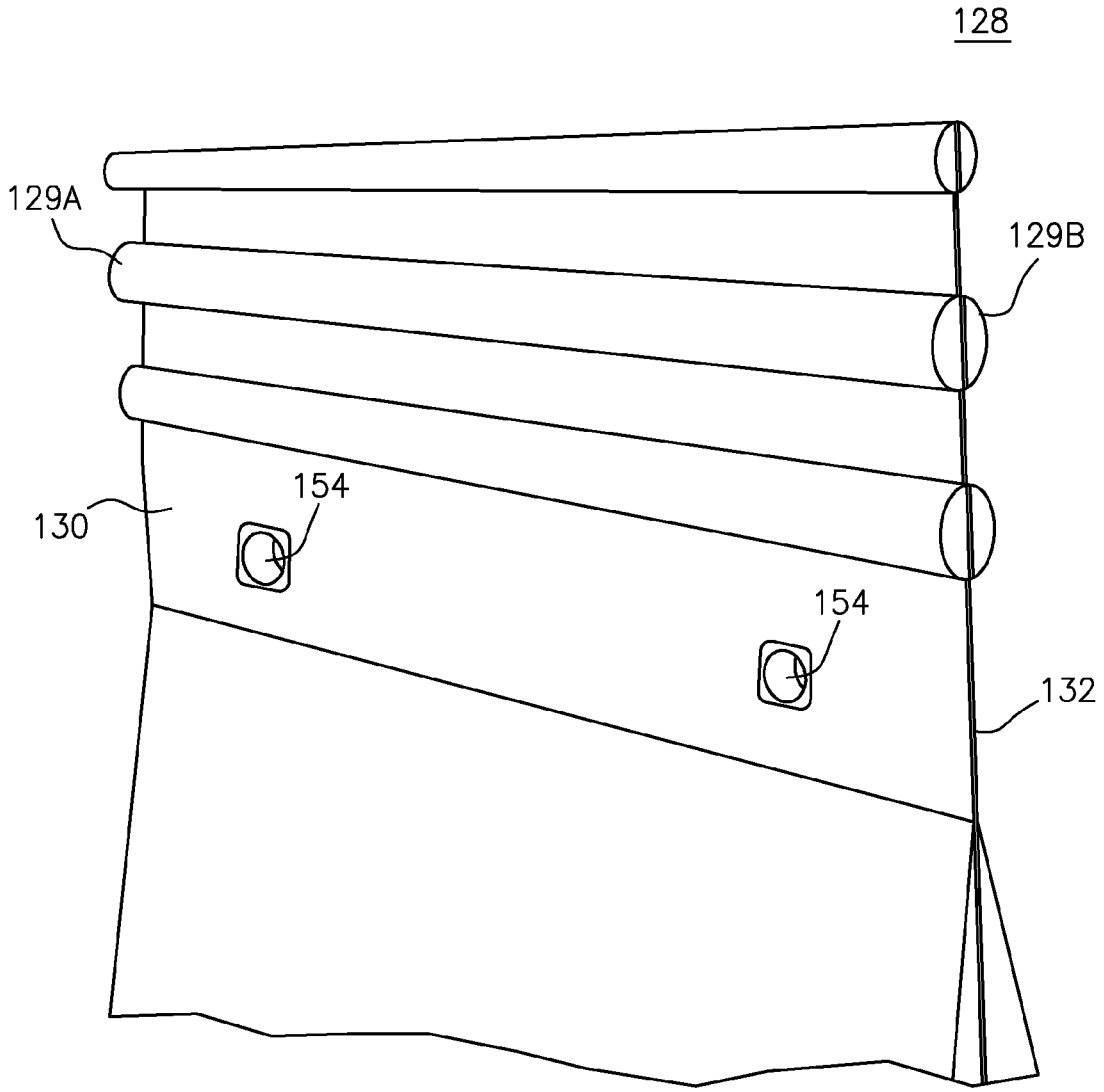

FIG. 5C illustrates a perspective view of the base member 128, according to an alternative embodiment. The first ridge member 129A and the second ridge member 129B each extend up to the peripheral edges of the first body 130 and the second body 132. As opposed to the embodiment described above respect to FIG. 5B, in the embodiment illustrated by FIG. 5C, the first groove members 188 and the second groove members 190 are not disposed between and/or adjacent to the first ridge member 129A and the second ridge member 129B. Thus, the peripheral edges of each of the first ridge member 129A and the second ridge member 129B extend up to, and are in the same plane as, the peripheral edges of the first body 130 and the second body 132, respectively. Since the first ridge member 129A and the second ridge member 129B provide a ledge in which the hair product 182 can rest without slipping up or down on the first body 130 and the second body 132, respectively, the first groove members 188 and the second groove members 190 may be optionally included, but are not necessary.

Figure 6:
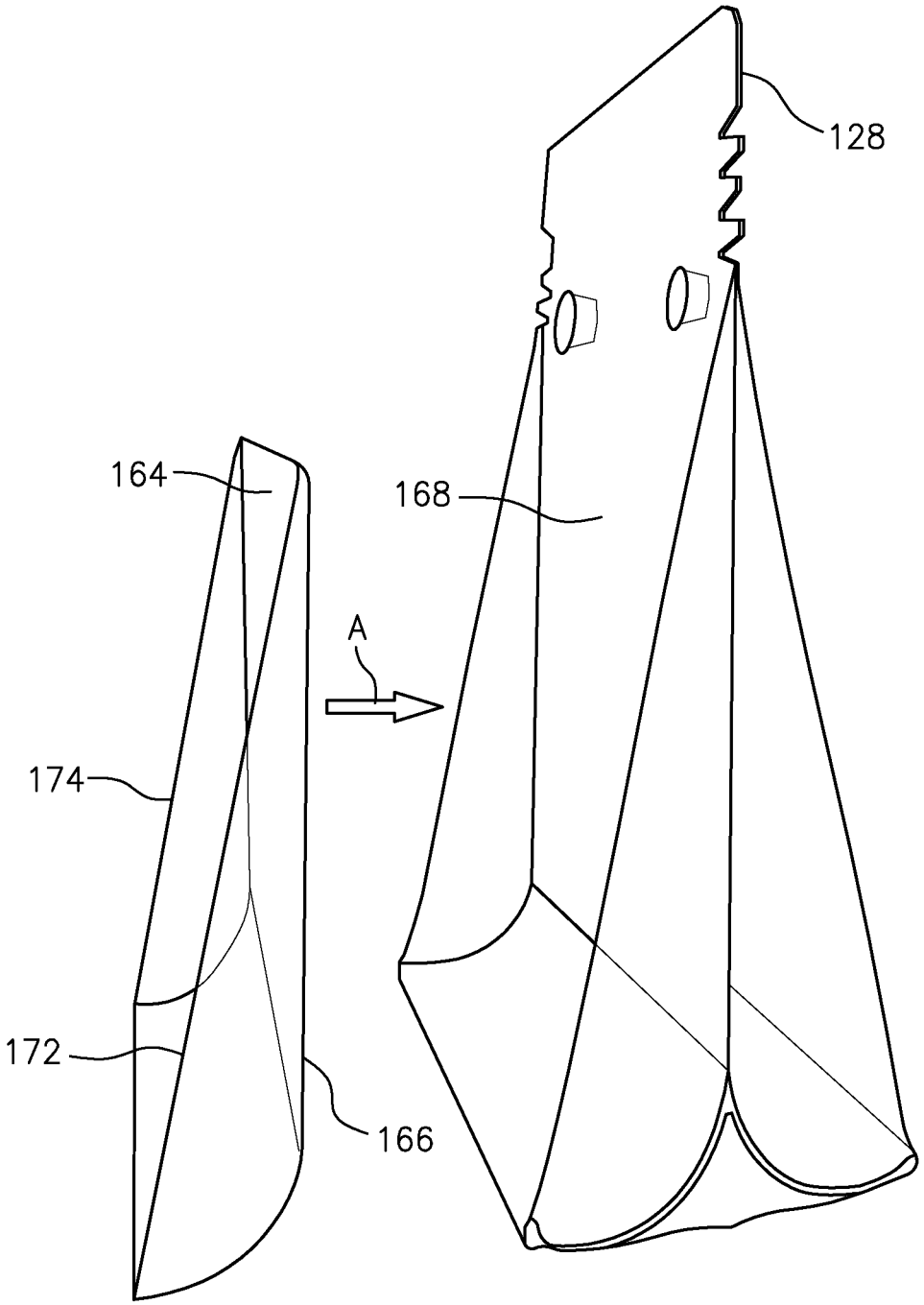
FIG. 6 illustrates a perspective view of a first securing member and the base member.

FIG. 6 illustrates a perspective view of a first securing member 164 and the base member 128. The first securing member 164 includes a first interior surface 166 that is disposed on the first exterior surface 168 of the first body 130 when the first securing member 164 and the first body 130 in an assembled configuration. The first securing member 164 is inserted onto the first body 130 in accordance with the direction of arrow A. The hair product 182, as described in further detail below, may be disposed between the first interior surface 166 and the first exterior surface 168 in order to maintain the contour of the hair product 182. The first securing member 164 may be secured to the first exterior surface 168 of the first body 130 by, for example, gunning or taping the first securing member 164 to the first body 130 in one or more locations.

The first securing member 164 includes a first securing member sidewall 172 and a second securing member sidewall 174, each extending perpendicularly away from edges of an exterior surface of the first securing member 164. A surface of the first securing member sidewall 172 and a surface of the second securing member sidewall 174 are substantially parallel. A width of a lower portion of the first securing member sidewall 172 is greater than a width of an upper portion of the first securing member sidewall 172. A width of a lower portion of the second securing member sidewall 174 is greater than a width of an upper portion of the second securing member sidewall 174. The first securing member sidewall 172 and the second securing member sidewall 174 are affixed to the first body sidewall 156 and the second body sidewall 158, respectively, by, for example, tape, glue or other methods of attachment.

FIG. 7 illustrates a perspective view of a hair product 182 coupled to the base member 128. A second securing member 176 includes a second interior surface 186 that is disposed on the second exterior surface 170 of the second body 132 when the second securing member 176 and the second body 132 are in an assembled configuration. The second securing member 176 includes a third securing member sidewall 178 and a fourth securing member sidewall 180, each extending perpendicularly away from edges of an exterior surface of the second securing member 176. A surface of the third securing member sidewall 178 and a surface of the fourth securing member sidewall 180 are substantially parallel. A width of a lower portion of the third securing member sidewall 178 is greater than a width of an upper portion of the third securing member sidewall 178. A width of a lower portion of the fourth securing member sidewall 180 is greater than a width of an upper portion of the fourth securing member sidewall 180. The third securing member sidewall 178 and the fourth securing member sidewall 180 are affixed to the third body sidewall 160 and the fourth body sidewall 162, respectively, by, for example, tape, glue, or other methods of attachment.

The second securing member 176 is inserted to be positioned between the third body sidewall 160 and the fourth body sidewall 162. A first portion of the hair product 182 is disposed between the first securing member 164 and the first exterior surface 168 of the first body 130 and a second portion of the hair product 182 is disposed between the second securing member 176 and the second exterior surface 170 of the second body 132. That is, hair from the first portion of the hair product 182 does not blend with hair from the second portion of the hair product 182 until removal from the assembly 100. Securing the hair product 182 between the first securing member 164 and the first exterior surface 168 of the first body 130 and between the second securing member 176 and the second exterior surface 170 of the second body 132 maintains the straight and curled portions of the hair product 182. The curl of the hair product 182 is maintained so that the curls align in one direction. That is, the hair product 182 is wrapped around the first groove members 188 and the second groove members 190 allowing the curls of the hair product 182 to align in one direction without having to cut the hair product 182 into separate pieces.

One or more padding members 184 may be disposed between each of the first exterior surface 168 of the first body 130 and the hair product 182, between the hair product 182 and an interior surface of the first securing member 164, between the second exterior surface 170 of the second body 132 and the hair product 182, and between the hair product 182 and an interior surface of the second securing member 176. The padding members 184 provide a boundary between the components of the assembly 100 described above and maintain the quality and integrity of the hair product 182. The padding members 184 also reduce static within the hair product 182 that may be caused by the plastic components of the assembly 100. The padding members 184 may be made of any type of material that reduces static, for example, Styrofoam, aluminum, etc.

Figure 8:
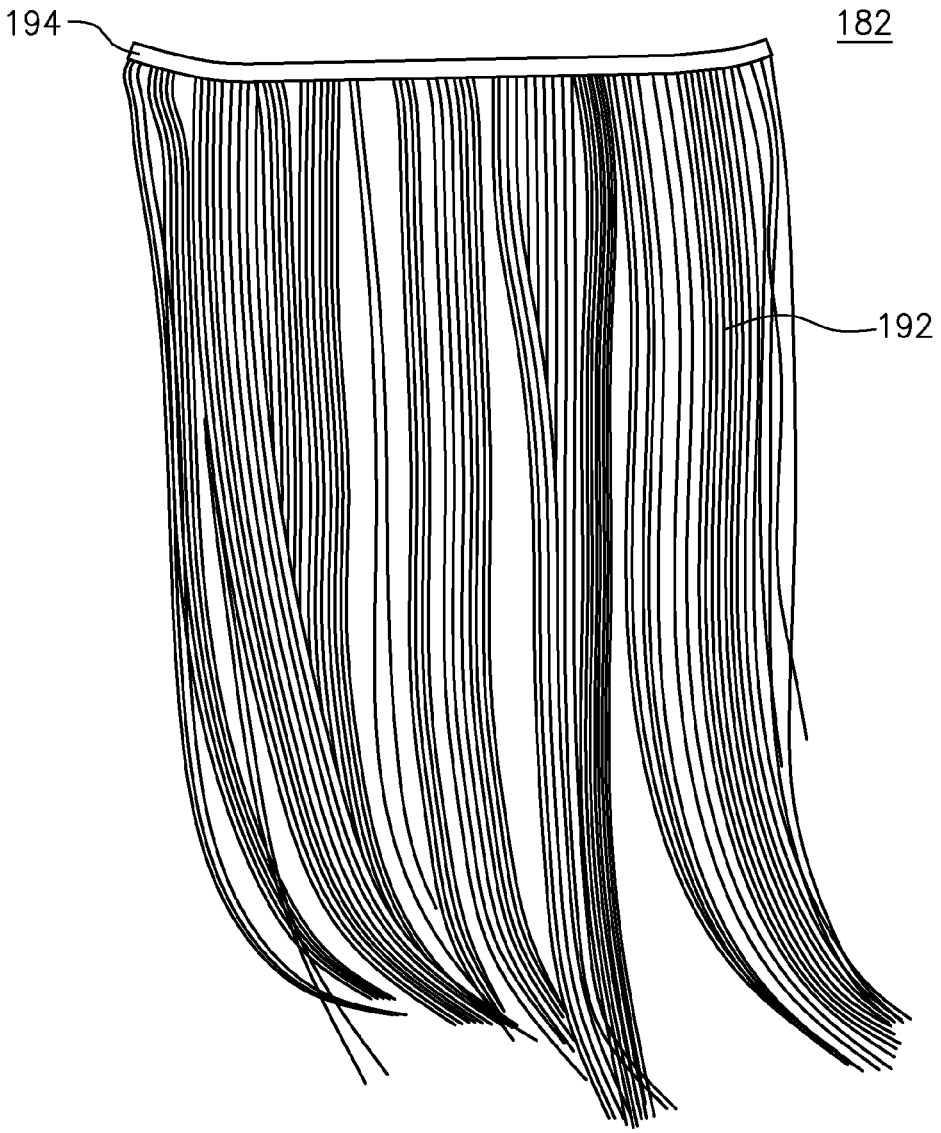
FIG. 8 illustrates a front view of a section of the hair product.

FIG. 8 illustrates a front view of a section of the hair product 182. The hair product 182 includes multiple flexible members 192 extending from an attachment tract 194. A proximal end of the flexible members 192 is connected to the attachment tract 194. The hair product 182 is secured to the base member 128 by wrapping the attachment tract 194 around the first groove members 188 and the second groove members 190. When a portion of the hair product 182 is disposed, for example, between the first interior surface 166 and the first exterior surface 168 and between the second interior surface 186 and the second exterior surface 170, the attachment tract 194 may not be disposed between the first interior surface 166 and the first exterior surface 168 and between the second interior surface 186 and the second exterior surface 170. That is, a portion of the hair product 182 may remain not disposed between either of the first interior surface 166 and the first exterior surface 168 or between the second interior surface 186 and the second exterior surface 170. The flexible members 192 may be artificial hair. Artificial hair refers to synthetic hair, human hair, and non-human animal hair.

A method of manufacturing an artificial hair package assembly 100 is also provided. The base member 128 includes a body portion and a support portion. The body portion includes a body planar surface and a body arcuate surface, and a securing member includes a securing member planar surface and a securing member arcuate surface. The method includes, in addition to the above description, securing a hair product 182 to the base member 128 and inserting the securing member such that a first portion of the hair product 182 is at least partially disposed between the body planar surface and the securing member planar surface. A second portion of the hair product 182 is disposed between the body arcuate surface and the securing member arcuate surface.

Each of the components of the assembly 100 described above may be constructed out of a rigid material including cardboard, plastic, or other suitable material. The plastic material may be either transparent or opaque.

The assembly 100 provides secure packaging to transport and display hair products, such as artificial hair. An individual desiring to purchase the hair product secured therewithin can view the hair product 120. The individual can then transport the hair product without causing damage to the form and appearance of the hair product. The assembly 100 also allows a manufacturer to ensure that the hair product 120 maintains a high quality appearance during shipping from the manufacturing facility to store shelves.

While embodiments of the invention have been shown and described with reference to certain embodiments thereof, it will be understood by those skilled in the art that various changes in form and details may be made therein without departing from the spirit and scope of the invention as defined by the appended claims and equivalents thereof.

What is claimed is:

1. An artificial hair package assembly, comprising:

a base member comprising a first body and a second body, the first body comprising a first exterior surface and the second body comprising a second exterior surface;

a first securing member comprising a first interior surface;

a second securing member comprising a second interior surface; and a hair product comprising a first portion and a second portion, the first portion being disposed between the first interior surface of the first securing member and the first exterior surface of the first body and the second portion being disposed between the second interior surface of the second securing member and the second exterior surface of the second body, wherein the first body comprises a first ridge member and the second body comprises a second ridge member, and wherein the first ridge member and the second ridge member are configured such that the hair product is secured to the base member by wrapping the hair product around the first ridge member and the second ridge member.

2. The artificial hair package assembly according to claim 1, wherein the first exterior surface of the first body and the second exterior surface of the second body face substantially opposite directions.

3. The artificial hair package assembly according to claim 1, wherein the first body comprises a first upper portion and a first lower portion and the second body comprises a second upper portion and a second lower portion, and wherein the first upper portion and the second upper portion comprise a first type of surface, the first lower portion and the second lower portion comprise a second type of surface, and the first type of surface is different from the second type of surface.

4. The artificial hair package assembly according to claim 1, wherein the first body comprises a first upper portion and a first lower portion and the second body comprises a second upper portion and a second lower portion, wherein the first upper portion comprises a first planar surface and the first lower portion comprises a first arcuate surface, and wherein the second upper portion comprises a second planar surface and the second lower portion comprises a second arcuate surface.

5. The artificial hair package assembly according to claim 4, wherein the first planar surface comprises at least more than half of a length of the first body and the first arcuate surface comprises less than half of the length of the first body.

6. The artificial hair package assembly according to claim 1, wherein the first body is connected to the second body by a support body, wherein the support body is disposed between the first body and the second body, and wherein a first lower portion of the first body is connected to the support body and a first upper portion of the first body is coupled to the second body by an attachment member, and wherein a second lower portion of the second body is connected to the support body and a second upper portion of the second body is coupled to the first body by the attachment member.

7. An artificial hair package assembly, comprising:

a base member comprising a body portion, the body portion comprising an exterior surface that comprises a body upper planar surface and a body lower arcuate surface;

a securing member comprising an interior surface, the interior surface comprising a securing member upper planar surface and a securing member lower arcuate surface; and a hair product comprising a first portion and a second portion, wherein the first portion is at least partially disposed between the body upper planar surface of the body portion and the securing member planar surface of the securing member and the second portion is at least partially disposed between the body lower arcuate surface of the body portion and the securing member lower arcuate surface.

8. The artificial hair package assembly according to claim 7, wherein the body planar surface comprises at least more than half of a length of the body portion and the body arcuate surface comprises less than half of the length of the body portion.

9. The artificial hair package assembly according to claim 7, wherein the body comprises a ridge member, and wherein the ridge member is configured such that the hair product is secured to the base member by wrapping the hair product around the ridge member.

10. The artificial hair package assembly according to claim 9, wherein the body portion comprises peripheral edges and the ridge member extends across the exterior surface from the peripheral edges of the body portion.

11. The artificial hair package assembly according to claim 7, wherein the first portion of the hair product contacts each of the body upper planar surface and the securing member planar surface and the second portion of the hair product contacts each of the body lower arcuate surface and the securing member arcuate surface.

12. An artificial hair package assembly, comprising:

a base member comprising a body portion, the body portion comprising an exterior surface;

a securing member comprising an interior surface;

a hair product;

a ridge member configured such that the hair product is secured to the base member by wrapping the hair product around the ridge member, wherein the hair product is at least partially disposed between the exterior surface of the body portion and the interior surface of the securing member.

13. The artificial hair package assembly according to claim 12, wherein the body portion comprises peripheral edges and the ridge member extends across the exterior surface from the peripheral edges of the body portion.

14. The artificial hair package assembly according to claim 12, wherein the hair product contacts each of the exterior surface of the body portion and the interior surface of the securing member.

15. The artificial hair package assembly according to claim 12, wherein the ridge member comprises a plurality of ridge members protruding from the exterior surface of the body portion.

16. The artificial hair package assembly according to claim 15, wherein the body portion further comprises a groove member disposed adjacent to at least one of the ridge members.

17. The artificial hair package assembly according to claim 16, wherein the groove member is disposed between at least two of the ridge members.

18. The artificial hair package assembly according to claim 15, wherein the ridge members extend a distance across the body portion greater than a distance between at least two of the groove members.

19. The artificial hair package assembly according to claim 12, wherein the body portion comprises a top edge and at least a portion of the ridge member extends across the top edge of the body portion.

* * * * *